US006568852B1

(12) United States Patent
Godshaw et al.

(10) Patent No.: US 6,568,852 B1
(45) Date of Patent: May 27, 2003

(54) EXPANDABLE CARRIER POUCH

(75) Inventors: Donald E. Godshaw, Evanston, IL (US); Andrezj M. Redzisz, Wheeling, IL (US); Henry Deutsch, Winnetka, IL (US)

(73) Assignee: Travel Caddy, Inc., Des Plaines, IL (US)

( * ) Notice: Subject to any disclaimer, the term of this patent is extended or adjusted under 35 U.S.C. 154(b) by 0 days.

(21) Appl. No.: 10/085,342

(22) Filed: Feb. 28, 2002

(51) Int. Cl.[7] ..... B65D 30/20

(52) U.S. Cl. ..... 383/2; 383/97; 383/120; 190/103

(58) Field of Search ..... 383/2, 97, 120; 190/103, 903

(56) References Cited

U.S. PATENT DOCUMENTS 3,443,671 A * 5/1969 Dyke ..... 190/103
D285,748 S * 9/1986 Feinberg et al. ..... D3/286
D286,229 S * 10/1986 Knoepke et al. ..... D3/286
4,773,515 A * 9/1988 Kotkins, Jr. ..... 190/103

FOREIGN PATENT DOCUMENTS

FR 1474951 * 3/1967

* cited by examiner

*Primary Examiner*—Jes F. Pascua
(74) *Attorney, Agent, or Firm*—Banner & Witcoff, Ltd.

(57) ABSTRACT

An expandable carrier or pouch includes a front and back panel connected by a double tab zipper with an expandable gusset joined between the panels.

5 Claims, 2 Drawing Sheets

FIG.1
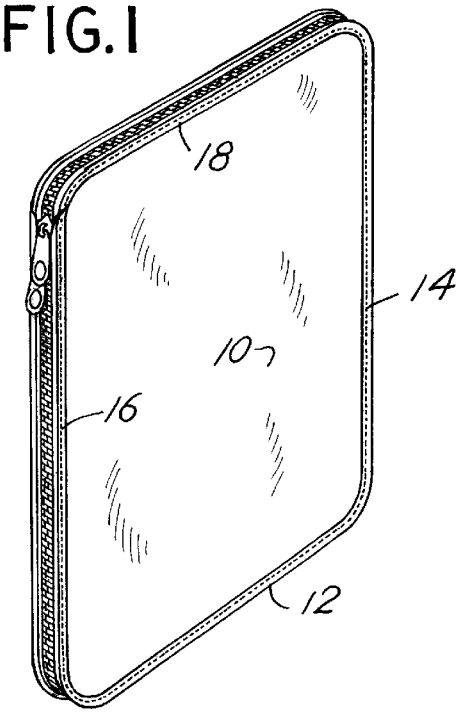
FIG.2
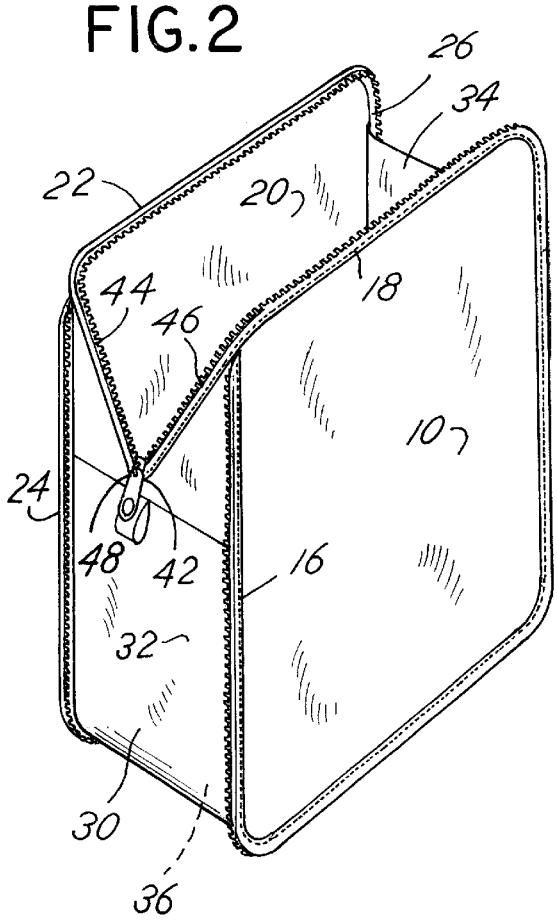
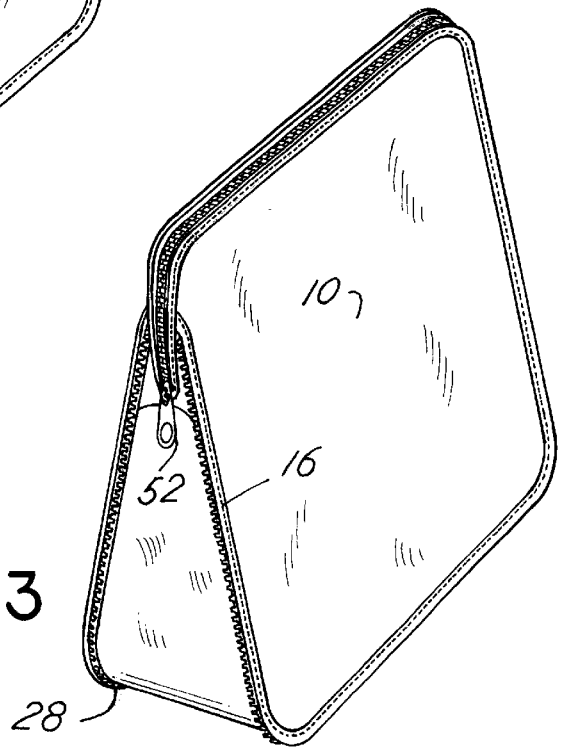
FIG.3

EXPANDABLE CARRIER POUCH

BACKGROUND OF THE INVENTION

In a principal aspect, the present invention relates to a flexible insulated carrier pouch having a zipper closure wherein the sides of the pouch are formed from congruent panels that overlie one another and are connected by a gusset or connecting panel which enables expansion of the pouch into a generally rectangular parallelepiped container.

Carrier pouches for lunches, soft drinks and the like are often made from flexible plastic or fabric material with insulation provided in the side walls of the pouch. Such containers, carriers or pouches are often made in the shape of a lunchbox, for example, or a purse or similar container and may have a limited capacity. That is, such pouches are typically not expandable. Additionally, pouches of this type which are expandable do not necessarily maintain their insulating characteristics. Further, such pouches, if expandable, are often bulky and difficult to convert between a reduced size and a large size. Thus, there has remained a need to provide an improved carrier pouch which is collapsible so that it may be easily stored or transported when not filled, yet which may be expanded to be filled with food or beverages.

SUMMARY OF THE INVENTION

Briefly, the present invention comprises an expandable container, pouch or bag which is comprised of flexible insulating panels joined together and convertible between an expanded mode and a contracted mode. The carrier pouch, bag or kit is comprised of overlying, generally rectangular, congruent front and back panels which are joined together by a connecting flexible wall or panel that forms a bottom and opposite lateral sides of an enclosure. The connecting panel is flexible and is fabricated so that the front and back panels may overlie one another and be joined together by a fastener mechanism, typically a zipper, which retains the front and back panels together by joining those panels along all four sides. The zipper may be partially released or fully released to form the insulated container into any one of three distinct modes; namely, (1) a fully compressed or closed configuration or mode, (2) a partially opened mode wherein the top of the container is accessible and open, and (3) a fully opened mode wherein the congruent front and back panels are totally separated one from the other and joined by the connecting gusset or a panel extending therebetween. Optional carrying straps are also provided.

Thus, it is an object of the invention to provide an improved insulating container or pouch which may be used for carrying food, beverages and the like.

It is a further object of the invention to provide an insulating container or pouch which may be expanded for holding beverages and other items.

Another object of the invention is to provide an efficient, yet economical and rugged insulating container which is expandable to carry items or which may be contracted for storage and transport or the like.

These and other objects, advantages and features of the invention will be set forth in the detailed description which follows.

BRIEF DESCRIPTION OF THE DRAWING

In the detailed description which follows, reference will be made to the drawing comprised of the following figures:

FIG. 1 is an isometric view of the container or pouch in the fully compact condition or mode;

FIG. 2 is an isometric view of the pouch of FIG. 1 wherein the top of the pouch or container is not open yet the lateral sides are expanded to separate the front and back panels one from the other;

FIG. 3 is an isometric view of the pouch of FIG. 1 in the fully opened condition;

DESCRIPTION OF THE PREFERRED EMBODIMENT

Figure 5:
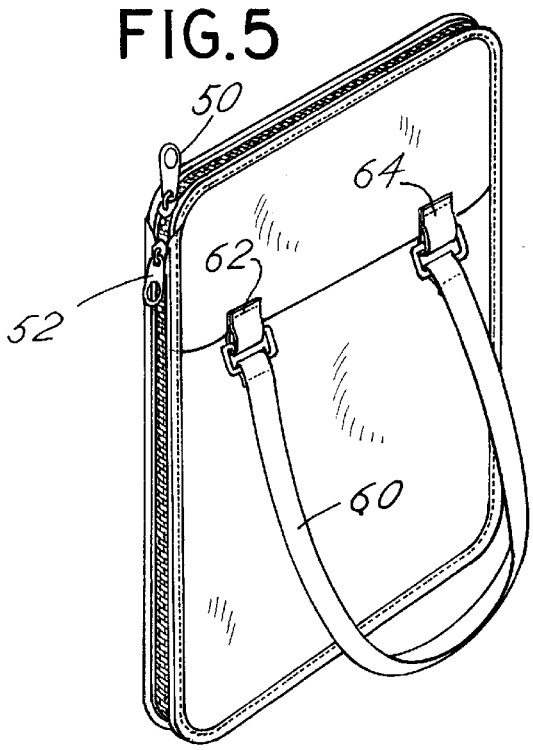
FIG. 5 is an isometric view similar to FIG. 1 wherein the pouch is depicted as including carrying straps.

Referring to the figures, the carrier pouch or kit of the invention includes a front panel 10 which is generally rectangular in shape and is comprised of a flexible material such as fabric, canvas or a plastic material. Panel 10 typically includes inner and outer walls with an insulating material, such as a foam layer, therebetween. Front panel 10 has a generally rectangular shape including a bottom edge 12, first lateral side edge 14, a second lateral side edge 16, and a top side or edge 18.

A back panel 20 which is congruent in size and shape with front panel 10 also includes sides or edges such as top side or edge 22, lateral side or edge 24 opposite lateral side or edge 26 and a bottom side or edge 28. The back panel 20 and front panel 10 being congruent are generally formed of the same material to provide insulating characteristics for the container.

Connected between the front panel 10 and back panel 20 is a third connecting panel or gusset 30 having a first lateral side 32, a second opposite, lateral side 34 and a connecting bottom side 36. The gusset or connecting third panel 30 is attached to front panel 10 and back panel 20 slightly inset from the edges of the front and back panels 10 and 20. Thus, for example, the side panel 32 is slightly inset from the side edge or lateral side 16 of front panel 10 and lateral side edge 24 of back panel 20. Preferably, the gusset or third panel 30 is comprised of insulating material and fabric which is flexible and may be compressed, yet which may be expanded or extended such as depicted in FIG. 3 so that the combination of front panel 10, back panel 20 and side panel 30 form an open top enclosure as depicted in FIG. 3.

The sides or edges 12, 14, 16, 18, 22, 24, 26, 28 of the front panel 10 and back panel 20 thus define peripheral margins. These peripheral margins include a fastening mechanism; namely, a zipper that extends entirely about the periphery of front panel 10 and back panel 20 and along the top edge or margin 33 of one lateral side 32 of the gusset or connecting panel, or third panel 30. The zipper joins the sides of that gusset 30 at a middle point, or middle section 42 of side panel 32. Thus, the side panel 32 includes a top edge or margin section 44 and a second top edge or margin section 46 joined at the midpoint 42. A zipper mechanism is provided, namely, a zipper 48 which connects the margins 44 and 46. The zipper or mechanism 48 also may be operated to connect edges 22 and 18, side edges 14 and 26, bottom edges 12 and 28 and then side edges 16 and 24. The zipper mechanism 48 depicted comprises both a first zipper operator or zipper tab 50 and a second tab 52 each of which operate the zipper mechanism 48. The tabs 50 and 52 include openings or other fastening mechanisms (not shown) which permit the tabs 50 and 52 to be joined, for example, by a small lock or other security device. In any event, tabs 50 and 52 may each move along the track for the zipper mechanism 48 to define the mode or shape the pouch as depicted in the figures. For example, the zipper mechanism may be fully closed as shown in FIGS. 1 and 5. The zipper 48 may be partially open as shown in FIG. 2 to permit the top of the enclosure to be closed, yet expanded to utilize the panel 30 to define the mode and shape of the pouch or kit.

Figure 4:
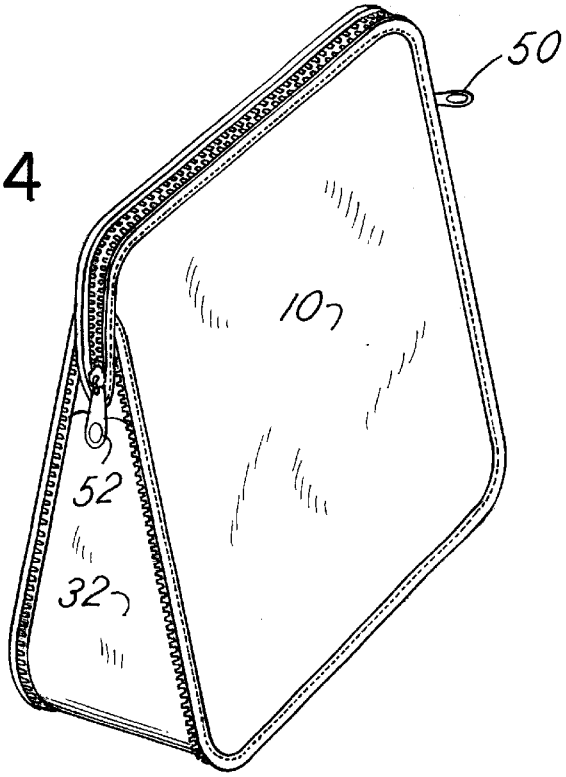
FIG. 4 is an isometric view of the pouch of FIG. 1 similar to FIG. 2 wherein the top of the container is open.

The zipper tabs 50, 52 may be moved entirely to the open position adjacent the midpoint 42 so that the mode of the pouch will be as depicted in FIG. 3. FIG. 4 depicts yet another mode wherein the zipper tabs 50 and 52 are both positioned on the opposite side of the midpoint connection 42. Thus, there are a myriad of positions and modes of utilization of the pouch. In a preferred embodiment, a flexible strap 60 is attached by means of connectors 62 and 64 to one of the panels or sides, for example, front panel 10. The strap 60 may, however, be connected to connectors on the front panel 10 and back panel 20 to provide a means for carrying the pouch.

Various fastener mechanisms besides zippers may be utilized. The sides and configuration of the panels 10 and 12 may be adjusted or changed. They may be circular, for example. The panels may also be triangular or some other geometric shape. Importantly, the peripheral edges or periphery of the panels are connected by an inset gusset, for example, gusset 30. Thus, the invention may be varied significantly without departing from the spirit and scope thereof. The invention is, therefore, to be limited only by the following claims and equivalents.

What is claimed is:

1. A carrier pouch comprising, in combination:

a first generally rectangular front panel having a top side, opposite lateral sides and a bottom side;

a second generally rectangular back panel congruent with the first panel and having a top side, opposite lateral sides and a bottom side;

said first and second panels each including an outer peripheral margin;

a third flexible connecting side and bottom gusset panel attached between the lateral sides and bottom sides of the first and second panels; said third gusset panel inset from the other peripheral margins; said third gusset panel having first and second end margins connecting the first and second panels on the opposite sides thereof and adjacent the top sides thereof to define an open top access and enclosure comprised of the joined panels, said end margins each having a midpoint; and a single, continuous closure mechanism joining the midpoint of one of the end margins and extending in serial order along the said one of said end margins to the opposed first and second panel top sides, then to one of said first and second panel lateral sides opposite the one of said end margins, to the first and second panel bottom sides and then the other of said first and second panel lateral sides to the top side; whereby the pouch provides multiple modes including (1) a closed top without joinder by the closure mechanism of the first and second panel lateral sides and bottom sides, (2) a closed top and joinder of all first and second panel sides, and (3) an open top without any joinder of the closure mechanism.

2. The pouch of claim 1 wherein the panels are comprised of flexible materials.

3. The pouch of claim 1 wherein selected panels are comprised of insulating materials.

4. The pouch of claim 1 wherein the closure mechanism comprises a zipper mechanism having first and second zipper control tabs.

5. The pouch of claim 1 further including a carrying strap attached to the first or second panels or both the first and second panels.

* * * * *